US006967308B1

(12) United States Patent
Iltis et al.

(10) Patent No.: US 6,967,308 B1
(45) Date of Patent: Nov. 22, 2005

(54) SYSTEM AND METHOD FOR INFORMATION HANDLING SYSTEM PERIPHERAL HEATING ELEMENT THERMAL FAILSAFE

(75) Inventors: Wayne Iltis, Austin, TX (US); Donald Guthan, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 13 days.

(21) Appl. No.: 10/841,203

(22) Filed: May 7, 2004

(51) Int. Cl.[7] ..... H05B 1/00

(52) U.S. Cl. ..... 219/216; 219/469; 219/494; 349/69; 349/330; 349/33; 313/578

(58) Field of Search ..... 219/216, 469, 219/471, 494; 399/69, 491, 33, 330, 328; 313/569, 491, 318.08, 578; 118/60; 432/60

(56) References Cited

U.S. PATENT DOCUMENTS

| | | | | | |
|---|---|---|---|---|---|
| 4,541,708 | A * | 9/1985 | Shigenobu | 399/33 |
| 4,628,183 | A * | 12/1986 | Satomura | 219/216 |
| 5,105,064 | A | 4/1992 | Kresock | 219/216 |
| 5,115,119 | A * | 5/1992 | Adachi et al. | 219/469 |
| 5,403,627 | A * | 4/1995 | Wilbert et al. | 427/554 |
| 5,565,734 | A * | 10/1996 | Pinot | 313/578 |
| 5,737,664 | A * | 4/1998 | Fukuda et al. | 399/33 |
| 5,778,278 | A * | 7/1998 | Jeon | 399/33 |
| 5,890,031 | A * | 3/1999 | Yokota et al. | 399/69 |
| 5,977,692 | A | 11/1999 | Itaya et al. | 313/37 |
| 6,222,158 | B1 * | 4/2001 | Nakata et al. | 219/216 |
| 6,297,585 | B1 | 10/2001 | Tashiro et al. | 313/318.08 |
| 6,555,948 | B1 * | 4/2003 | Noll | 313/112 |
| 6,580,896 | B2 * | 6/2003 | Lee | 399/330 |
| 6,911,625 | B2 * | 6/2005 | Shimonaka | 219/216 |
| 2003/0230568 | A1 * | 12/2003 | Yamanaka | 216/665 |

* cited by examiner

*Primary Examiner*—Robin O. Evans
*Assistant Examiner*—Leonid Fastovsky
(74) *Attorney, Agent, or Firm*—Hamilton & Terrile, LLP; Robert W. Holland

(57) ABSTRACT

Information handling system peripherals that use a heating element are protected from catastrophic failure due to overheating by a thermal failsafe associated with the heating element that fails the heating element if excessive temperatures are reached. For instance, the failsafe releases the vacuum from a heating element bulb so that the application of power to the filament of the heating element bulb oxidizes the filament resulting in failure of the filament and ceasing of generation of heat. The failsafe includes a melting agent, such as wax or solder, which seals an opening in the bulb unless a thermal runaway temperature is reached in excess of a desired operating temperature. Alternatively, the failsafe includes an expanding agent, such as a ceramic or a liquid-filled bubble, which releases the vacuum by fracturing an opening in the bulb at the thermal runaway temperature. The thermal runaway temperature is selected to induce failure before catastrophic overheating of the peripheral.

8 Claims, 2 Drawing Sheets

SYSTEM AND METHOD FOR INFORMATION HANDLING SYSTEM PERIPHERAL HEATING ELEMENT THERMAL FAILSAFE

BACKGROUND OF THE INVENTION

1. Field of the Invention

The present invention relates in general to the field of information handling system peripherals, and more particularly to a system and method for an information handling system printer heating element thermal fuse.

2. Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems often interact with a number of peripherals to communicate, print or otherwise process information. For instance, ink jet and laser printers are typically used to print information, such as documents and photographs. Printers often include heating elements that supply heat during the printing process. For example, laser printers generally include a heating element within a printing drum to heat the printing drum so that toner affixes to paper pressed against the printing drum. The heating element is generally enclosed in a vacuum formed in a bulb, similar to a light bulb, so that the element does not oxidize and thus fail. A temperature controller selectively applies power to the heating element in order to maintain the printing drum in a desired temperature range. Insufficient heating of the printing drum will result in failed or suboptimal transfer of toner to paper that contacts the drum. Excessive heating of the printing drum will result in the failure of printer components and, possibly, a fire hazard if heat from the printing drum is sufficient to light the paper or other combustible material on fire. Other types of information handling system peripherals also use similar vacuum-enclosed heating elements for generating heat due to their simplicity and responsiveness.

One difficulty that arises with heating elements occurs if the temperature controller fails in a state that has power applied to the heating element. When left uncontrolled in the on position, heating elements typically overheat in a rapid manner resulting in catastrophic damage. A number of different types of safety devices are sometimes used in order to prevent overheating from excessive power applied to a heating element, such as those commonly found in laser printers. For instance, temperature sensors located near the heating element sense when an excessive temperature is reached, such as in the event of a failure of a temperature controller, and turn off power to the heating element. However, such electrical failsafe sensors are themselves subject to failure, such as by inadvertent bypassing of the sensor, incorrect installation of the sensor or outright sensor failure. Some non-electrical systems warn of overheating with visual indications, such as by displaying a color change with material that melts or is otherwise temperature sensitive above a certain temperature range. However, in order for such visual warning systems to work, a user must generally detect the warning and react to the overheating condition before damage occurs. Other types of safety systems attempt to respond to the fire risk that arises in overheating conditions by releasing fire retardant, such as halogen released by the breaking of a glass vial once a certain temperature is exceeded. However, fire retardants do not directly address reducing the heat generated by the light and often initiate only after catastrophic failure.

SUMMARY OF THE INVENTION

Therefore a need has arisen for a system and method which automatically shuts down a heating element in the event of an over temperature.

In accordance with the present invention, a system and method are provided which substantially reduce the disadvantages and problems associated with previous methods and systems for detecting and correcting the overheating of a vacuum-enclosed heating element. A failsafe integrated with the heating element fails the heating element at a predetermined temperature by releasing the vacuum from within the bulb to prevent generation of heat. Activation of the failsafe occurs with heat that exceeds the operating temperature associated with a device that uses the heating element and seeks to fail the heating element before heat damage occurs to the device.

More specifically, an information handling system peripheral, such as a laser printer uses a heating element to generate an operating temperature associated with transfer by a printing drum of printing material, such as toner, to a print media, such as paper. A temperature controller intermittently applies power to the heating element to maintain the operating temperature. In the event of inadvertent over heating by the temperature controller to a predetermined degree in excess of the operating temperature, a failsafe integrated in the heating element activates to fail the heating element and thus prevent generation of heat. For instance, a melting agent, such as solder or wax, integrated in the evacuation port of the heating element melts at the predetermined over temperature to release the vacuum from the heating element and thus preclude the filament within the heating element from generating heat. Alternatively, an expanding agent, such as a ceramic or a gas or liquid bubble, integrated in the evacuation port of the heating element expands to fracture the heating element at the predetermined over temperature to release the vacuum from the heating element and thus preclude the filament within the heating element from generating heat.

The present invention provides a number of important technical advantages. One example of an important technical advantage is that over temperature of a heating element is automatically detected and corrected with a temperature-induced failure of the vacuum within the heating element bulb to oxidize and fail the heating element. The over-temperature induced failure mechanism is integrated within the heating element so that failsafe protection does not depend on proper installation and operation of separate systems within an information handling system peripheral. The failure temperature is selectable in the design of the heating element to prevent catastrophic failure within the peripheral.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Information handling system peripherals that use heating elements, such as laser printers, are protected from catastrophic failure due to thermal runaway of the heating element with an over temperature induced failure of the heating element by an integrated failsafe. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
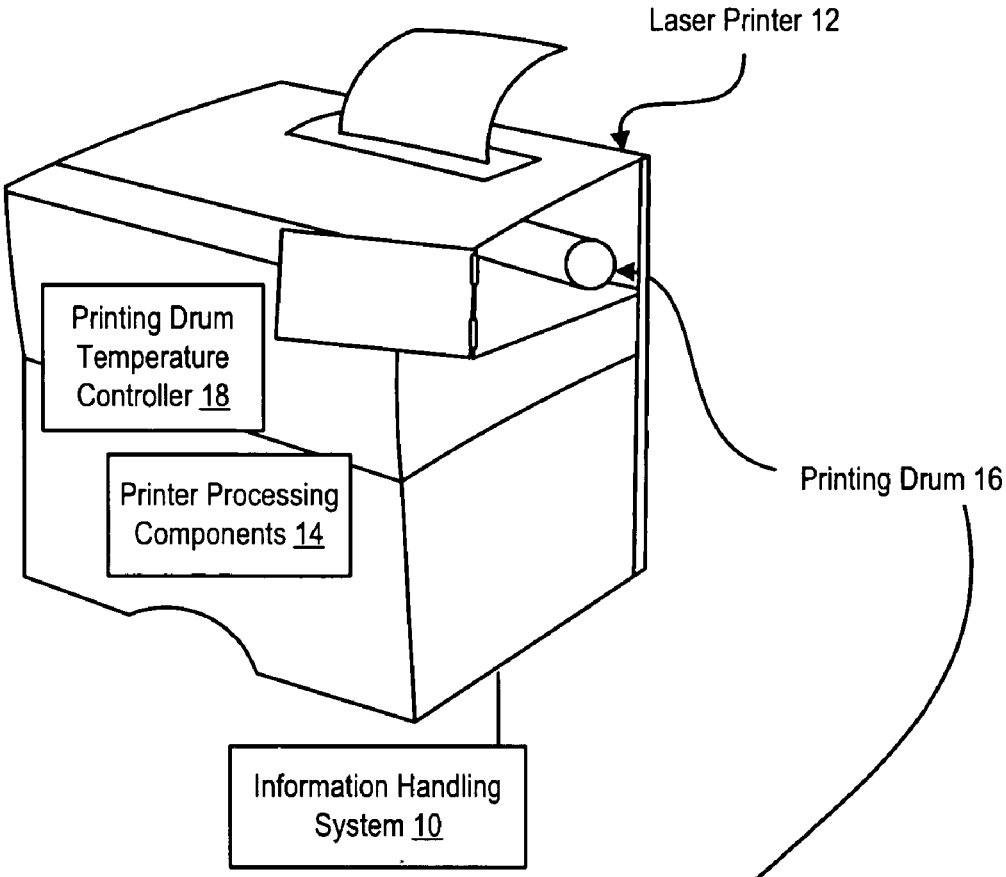
FIG. 1 depicts a block diagram of an information handling system interfaced with a laser printer.

Referring now to FIG. 1, a block diagram depicts an information handling system 10 interfaced with a laser printer 12. Information handling system 10 processes information for printing, such as documents or pictures, and communicates the information to laser printer 12, such as over a USB cable. Printer processing components 14 associated with laser printer 12 accepts the information from information handling system 10 and prepares the information for transfer to print media, such as paper, by affixing print material to the print media, such as toner. The information is affixed to the print media at a printing drum 16, which rotates to move the paper through the printer. In order to affix toner to paper, printing drum 16 is heated by an internal heating device that is controlled by a printing drum temperature controller 18. On initial power up of laser printer 12, printing drum temperature controller 18 commands the generation of heat until a desired operating temperature is achieved and thereafter intermittently commands the generation of heat to maintain the operating temperature without creating an over temperature condition by commanding excessive heat generation. Generally, the greater the heat generating capability of a laser printer drum heating device the better the response time of the laser printer to a print request from a powered down condition and the greater the risk of damage if a runaway heating device creates an over temperature condition.

Figure 2:
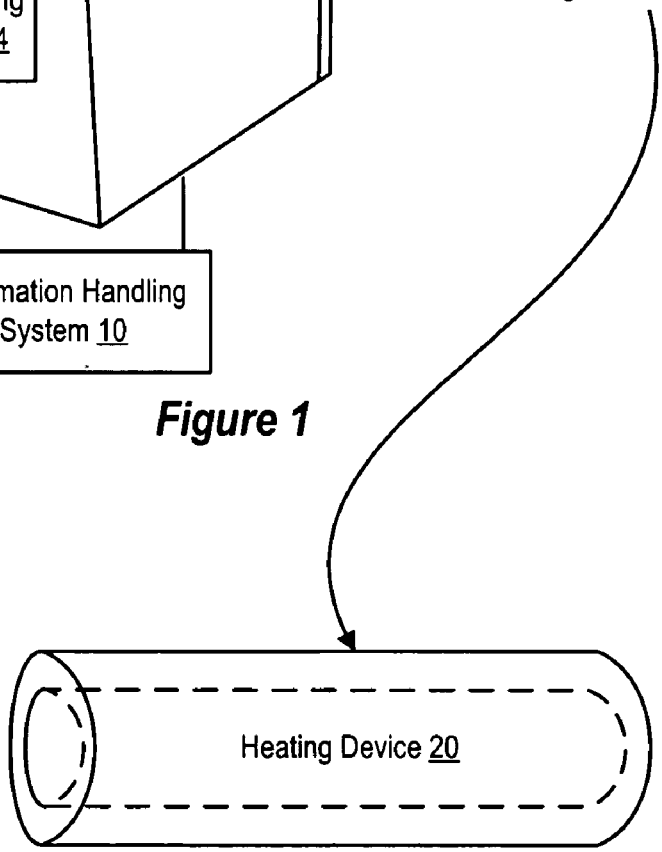
FIG. 2 depicts a blown-up view of the laser printer's printing drum and heating device.
Figure 3:
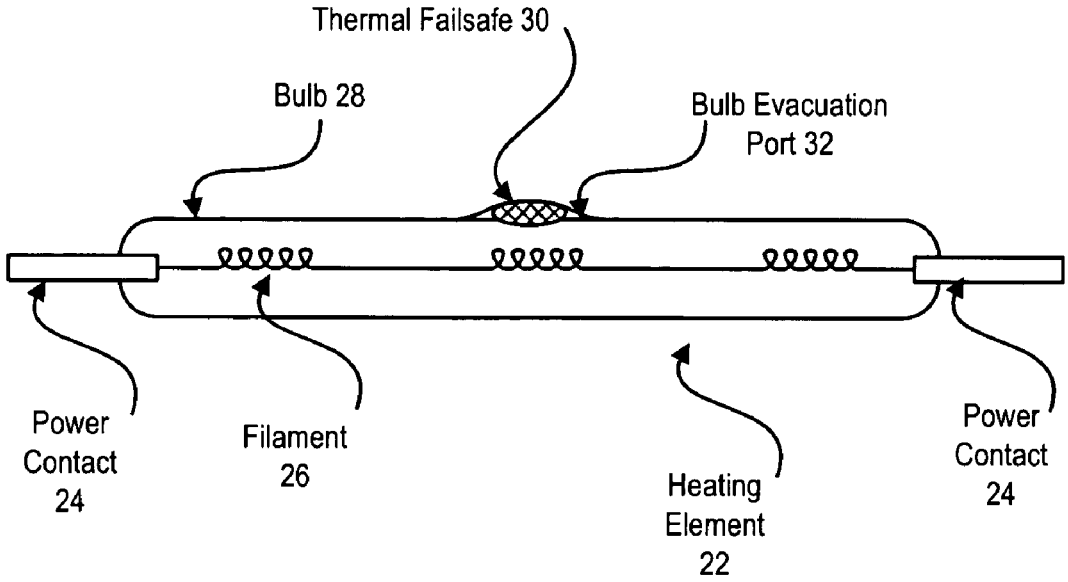
FIG. 3 depicts a side view of a failsafe heating element that inserts into the printing drum heating device.

Referring now to FIG. 2, a heating device 20 is depicted disposed within the interior of printing drum 16. Heating device 20 is a cylindrical metal tube that inserts into an opening of printing drum 16 and accepts electrical power applied by printing drum temperature controller 18 to generate heat with an internal heating element. FIG. 3 depicts a heating element 22 that inserts into heating device 20 to generate heat. Heating element 22 is essentially a light bulb that accepts electrical power through power contacts 24 but that generates heat rather than light by running current through a filament 26 maintained in a vacuum by a bulb 28. Heating element 22 is made of rugged components that will withstand multiple intermittent applications of power in a high temperature-operating environment, however, failure of the vacuum leads to rapid failure of the filament due to oxidation introduced via the atmosphere external to the bulb.

Figure 4:
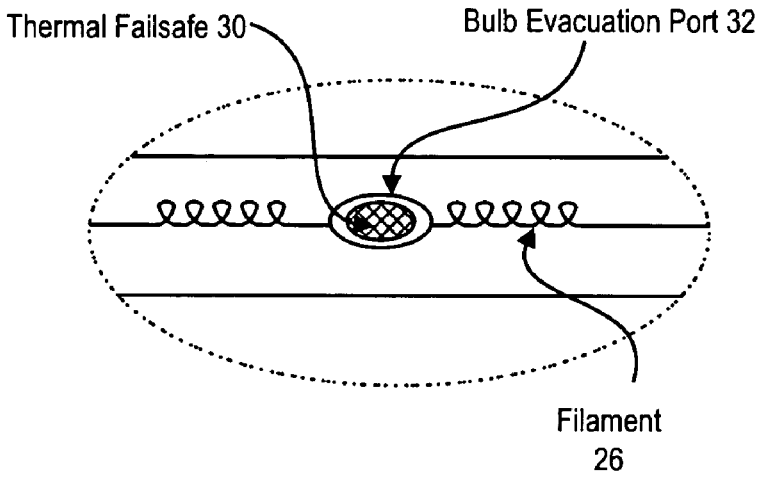
FIG. 4 depict a top view of a thermal failsafe integrated in the evacuation port of a heating element bulb.

As depicted by FIGS. 3 and 4, heating element 22 includes a thermal failsafe 30 that maintains the vacuum within bulb 28 but that releases the vacuum from bulb 28 if an excessive temperature is reached, thus inducing a failure of heating element 22. For instance, thermal failsafe 30 is a melting agent or an expanding agent inserted in an evacuation port 32 of bulb 28 during manufacture of heating element 22. Evacuation port 32 is the point on the surface of bulb 28 from which a vacuum is created at manufacture by removing air from within bulb 28. Instead of sealing evacuation port 32 with melted bulb material after the vacuum is created, a melting agent or expanding agent is used that will induce failure of the vacuum within bulb 28 at a predetermined temperature. For instance, melting agents include solder or wax which maintain a solid state at the operating temperature to seal evacuation port 32 and melt at a predetermined thermal runaway temperature to release the vacuum from within bulb 28. Expanding agents include a ceramic material or a liquid or gas bubble integrated within bulb 28 that expand to fracture bulb 28 at the predetermined thermal runaway temperature, thus releasing the vacuum. Although evacuation port 32 is a convenient location for placement of thermal failsafe 30, other placements along bulb 28 or contacts 24 may be used that have access to release the vacuum.

In operation, thermal failsafe 30 does not activate or otherwise impede heat generation by heating element 22 within normal operating temperatures. However, in the event of a malfunction of printer drum temperature controller 18 that increases the heat generation by heating element 22 to an excessive level, thermal failsafe 30 activates to fail heating element 22 before catastrophic damage occurs to laser printer 12. The activation temperature of failsafe 20 is selectable by the type of melting or expanding agent used so that inadvertent failures of heating element 22 are avoided by too low of a failsafe temperature while damage to the peripheral is prevented by too high of a failsafe temperature. Generally, the activation temperature is selected as a temperature differential of a predetermined amount over the operating temperature of the peripheral. Thus, in different types of information handling system peripherals, varying failsafe activation temperatures may be selected based on the operating temperature and the sensitivity of the peripheral to heat damage.

Although the present invention has been described in detail, it should be understood that various changes, substitutions and alterations can be made hereto without departing from the spirit and scope of the invention as defined by the appended claims.

What is claimed is:

1. An information handling system laser printer peripheral for printing information on a print media with toner, the laser printer peripheral comprising:

processing components operable to formulate information with toner for transfer to a print media;

a printing drum operable to carry the print media proximate the processing components to accept the toner formulated to print the information;

a heating device disposed proximate the printing drum and operable to generate an operating temperature associated with transfer of toner to print media; and a heating element installed in the heating device, the heating element having a filament disposed in bulb, the bulb maintaining a vacuum, the filament operable to accept intermittent application of power from the heating device to generate heat in the vacuum for heating the printing drum to the operating temperature, the bulb having an integrated thermal failsafe operable to induce failure of the vacuum in the event of a predetermined thermal runaway temperature.

2. The laser printer peripheral of claim 1 wherein the thermal failsafe comprises a melting agent disposed in the bulb and operable to melt at the thermal runaway temperature thereby releasing the vacuum.

3. The laser printer peripheral of claim 2 wherein the thermal failsafe comprises wax disposed in an evacuation port of the bulb, the wax melting at the thermal runaway temperature.

4. The laser printer peripheral of claim 2 wherein the thermal failsafe comprises solder disposed in an evacuation port of the bulb, the solder melting at the thermal runaway temperature.

5. The laser printer peripheral of claim 1 wherein the thermal failsafe comprises an expanding agent disposed in the bulb and operable to expand at the thermal runaway temperature to break the bulb thereby releasing the vacuum.

6. The laser printer peripheral of claim 5 wherein the thermal failsafe comprises a ceramic plug disposed in the evacuation port of the bulb, the ceramic plug expanding to create a breaking force at the thermal runaway temperature.

7. The laser printer peripheral of claim 5 wherein the thermal failsafe comprises a liquid bubble disposed in the bulb, the liquid expanding to create a breaking force at the thermal runaway temperature.

8. The laser printer peripheral of claim 5 wherein the thermal failsafe comprises a gas bubble disposed in the bulb, the gas expanding to create a breaking force at the thermal runaway temperature.

* * * * *